US005141062A

United States Patent [19]

Anderson

[11] Patent Number: 5,141,062

[45] Date of Patent: Aug. 25, 1992

[54] TOOL ACTUATOR

[76] Inventor: Charles A. Anderson, 78A Stanley Street, Aberdeen AB1 6UQ, Scotland

[21] Appl. No.: 548,058

[22] Filed: Jul. 5, 1990

[30] Foreign Application Priority Data

Jul. 4, 1989 [GB] United Kingdom ..... 8915302

[51] Int. Cl.[5] ..... E21B 23/04

[52] U.S. Cl. ..... 175/234; 175/320; 166/319; 166/386

[58] Field of Search ..... 175/234, 320, 269, 291; 166/386, 323, 319, 374

[56] References Cited

U.S. PATENT DOCUMENTS 4,106,823 8/1978 Bassinger ..... 308/4 A
4,821,817 4/1989 Cendre ..... 175/269
4,848,490 7/1989 Anderson ..... 175/323
4,851,760 7/1989 Cendre ..... 175/269
4,893,675 1/1990 Skipper ..... 175/269
4,917,191 4/1990 Hopmann et al. ..... 166/386

*Primary Examiner*—Terry L. Melius

[57] ABSTRACT

A tool actuator which comprises a casing containing a pipe, which is movable from a locking position to an unlocking position, under the action of a fluid pumped through the casing. When the pipe is in the locking position it locks a mandrel in an activating or deactivating position. When the pipe is in the unlocking position it does not contact the mandrel which is therefore free to move between the activating and a deactivating positions. The fluid pressure will be different for each of the positions of the pipe and mandrel and consequently their position can be monitored by monitoring the pressure of the fluid, for a given fluid flow rate.

5 Claims, 7 Drawing Sheets

TOOL ACTUATOR

This invention relates to a tool actuator, particularly but not exclusively for use in situations where a supply of fluid pressure is available, for example in downhole drilling.

In downhole drilling there is often a need to move a tool between an activated and a deactivated position. Frequently there is the additional need to lock the tool in either of these positions and unlock it for movement between the positions.

There are a number of tools in regular use in downhole drilling which may be actuated in this way such as wireline tools, fishing tools, reamers and drill string stabilizers.

Drilling mud may be pumped down through the drill string when any of the above tools are in use, the drilling mud being required for lubrication at the drill head, and for other standard functions.

It is an object of the present invention to provide a tool actuator which enables a down hole tool to be remotely actuated from the well surface, and to be locked in an actuated position, unlocked for movement between positions and locked in a de-activated position and vice-versa. It is also preferable that the actuator can be monitored at all times from the surface by monitoring the drill mud pressure.

If we take the drill string stabilizers as an example, it has become a standard practice in the oil and gas industries to drill a number of wells from a single surface location or offshore platform. In this practice a number of wells are drilled initially substantially vertically downwards and thereafter their inclination is varied with respect to both the horizontal and vertical planes.

In order for the well's inclination to be varied accurately the control of inclination is normally undertaken by downhole stabilizers.

In the most general terms, known forms of drill string stabilizers consist of a collar or cylindrical member which fits around or into a drill string near the lower end of the string. There are two different types of stabilizers: a) fixed stabilizers which are basically collars of a set diameter, normally substantially equal to that of the downhole bore diameter, which thus prevent the drill string from bowing and therefore from changing inclination; and b) variable stabilizers which are collars with variably positioned protrusions or buttons which can be retracted, allowing the drill string to bow and thus change inclination, or extended so as to contact the sides of the well and thus prevent bowing of the drill string, forcing the drill to continue in a straight undeviated inclination.

The major problem with fixed stabilizers is that the entire drill string must be withdrawn to remove a stabilizer from the drill string and replace it with a smaller diameter stabilizer, in order to change the drilling inclination. This process results in the drilling being suspended each time the drilling inclination is to be changed, which is extremely expensive.

Variable stabilizers which can be actuated from the surface, normally by the controlled application of weight on the drill string, overcome this problem. In this arrangement applying weight to the drill string results in the axial movement of a mandrel within the stabilizer casing which causes the buttons to protrude and contact the sides of the well. Removing the weight results in the mandrel moving in the opposite axial direction and causes the buttons to retract.

According to a first aspect of the present invention there is provided a tool actuator, comprising a casing containing a first member movable between an unlocking position and a locking position under the action of a fluid flowing within the casing, a second member, for controlling actuation of the tool, movable between an activating and a deactivating position, the first member when in the locking position being arranged to prevent movement of the second member between its two positions, and the first member when in the unlocking position being arranged to allow movement of the second member between its two positions, whereby the second member permits activation and deactivation of the tool.

Preferably, the tool actuator further comprises a biasing means which biases the first member into the unlocking position when the pressure produced by the fluid falls below a preset level.

Preferably, the tool actuator further comprises an obstructor member which limits the area within the casing through which the fluid may flow.

Preferably, the obstructor member is formed as a substantially cylindrical member, which tapers outwards towards its lower end.

Preferably, the first member includes an annular collar which projects towards the center of the casing such that the area within the casing through which the fluid may flow is defined as the area between the collar and the obstructor member.

Preferably, for a constant flow rate, the pressure of the fluid is determined by the position of the collar with respect to the obstructor member.

Preferably, the tool actuator further comprises a pressure sensor positioned such that the pressure of the fluid can be measured and the pressure measurement transmitted to a point distant from the obstructor member.

Most preferably, when the first member is in the unlocking position the collar is positioned in line with a first part of the obstructor member of a first radius, resulting in a first fluid pressure, for a given fluid flow rate.

Most preferably, when the first member is in the locking position and the second member is in the activating position, the collar is positioned in line with a second part of the obstructor member of a second radius, resulting in a second fluid pressure, for a given fluid flow rate.

Most preferably, when the first member is in the locking position and the second member is in the deactivating position, the collar is positioned in line with a third part of the obstructor member of a third radius, resulting in a third fluid pressure, for a given fluid flow rate.

According to a second aspect of the present invention there is provided a drill string stabilizer, comprising a means of stabilizing the drill string which is remotely actuated by the positioning of a tapered mandrel which is coaxially mounted within an outer casing of the drill string; the inner side of the said outer casing being formed with two axially spaced annular surfaces which engage an abutment connected to the uppermost end of the mandrel so as to locate the mandrel in one of two positions, namely an activated position where the position of the mandrel causes the means of stabilization to be activated and a deactivated position where the position of the mandrel causes the means of stabilization to be deactivated; a coaxially mounted substantially cylindrical pipe the position of which, with respect to the stabilizer casing, is determined by the net force on the pipe due to the downward pressure exerted on the pipe by the flow of drilling mud which is pumped axially down through the center of the stabilizer and the upward pressure exerted on the pipe by a biasing spring located between the pipe and outer casing so that, in conditions of high mud flow rate the pipe is biased downwards and contacts the abutment of the mandrel and thus locks the mandrel in one of the two said positions and in conditions of low mud flow rate the biasing spring biases the pipe away from the mandrel, which thus frees the mandrel to move between the two said positions.

Preferably, the stabilizer includes an obstructor member fixed within the casing to vary the area within the casing through which the fluid may flow as the pipe is moved with respect to the obstructor member.

Preferably, the means of stabilization comprises a plurality of radially movable buttons which are mounted so as to be movable by the mandrel between an activated position, where the buttons extend outwardly from the stabilizer and contact the walls of the well and a deactivated position where the buttons are retracted within the body of the stabilizer.

Preferably, the pipe comprises an annular collar near the uppermost part of the pipe which both increases the area of the pipe which is acted upon by the drilling mud and decreases the open area between the pipe and the obstructor member thus increasing the pressure of the mud for a constant mud flow rate.

Most preferably, the said axially spaced annular surfaces are the two sides of an annular collar or abutment.

Embodiments of the present invention will now be described, by way of example, with reference to the accompanying drawings in which.

Figure 1:
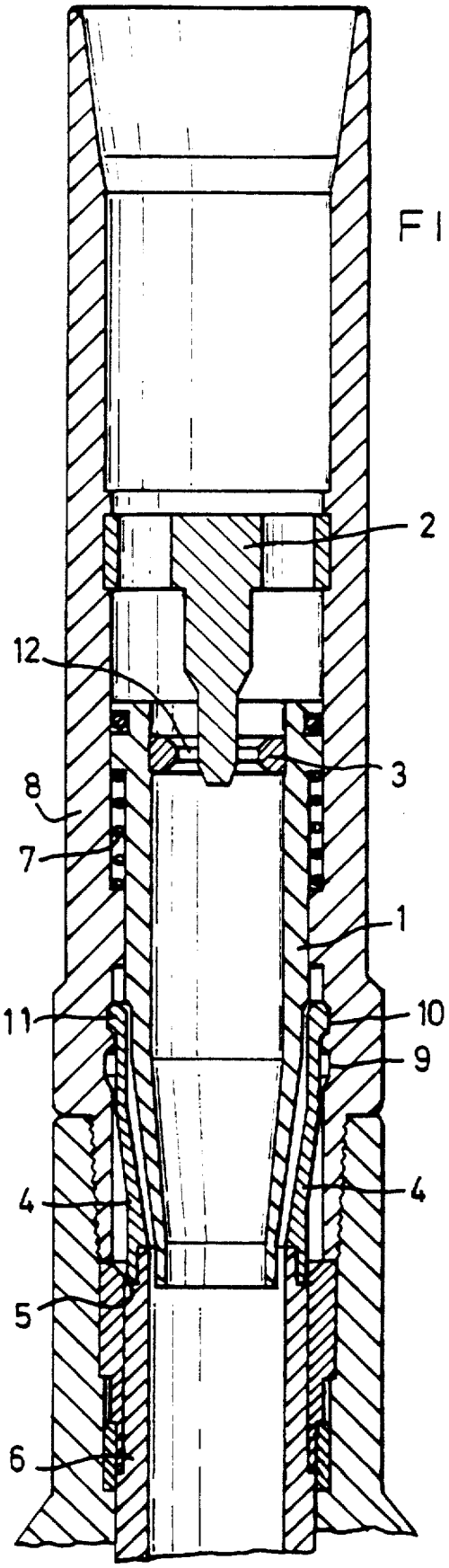
FIG. 1 is an axial sectional view of a first embodiment of a tool actuator in accordance with the present invention in a locked, activating position.
Figure 2:
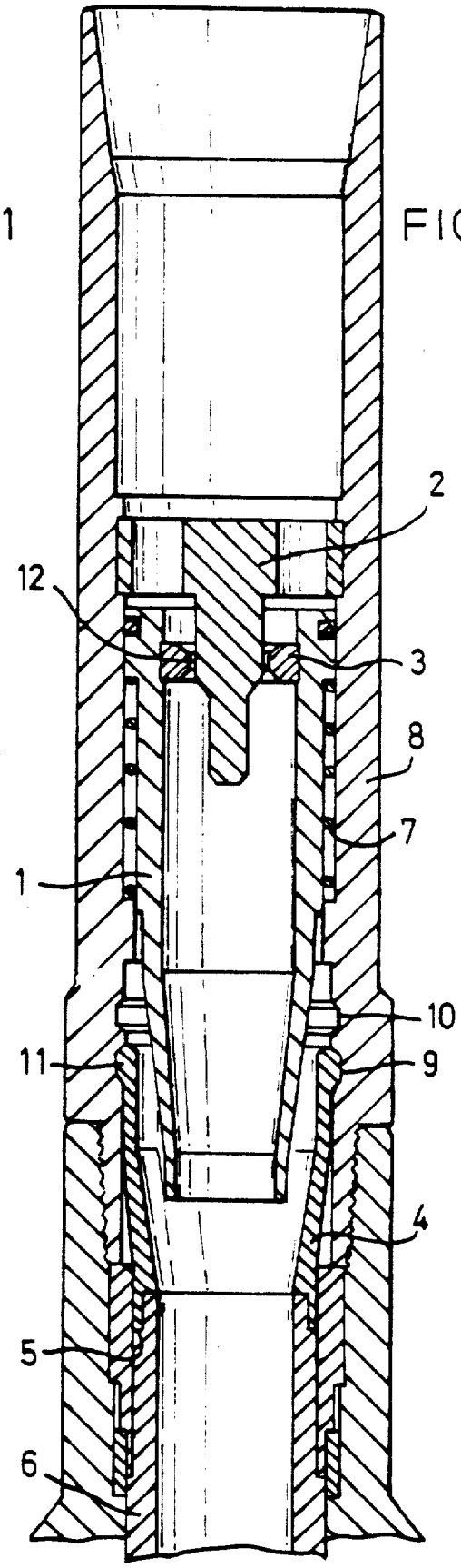
FIG. 2 is a similar view of the tool actuator of FIG. 1, in an unlocked, activating position.
Figure 3:
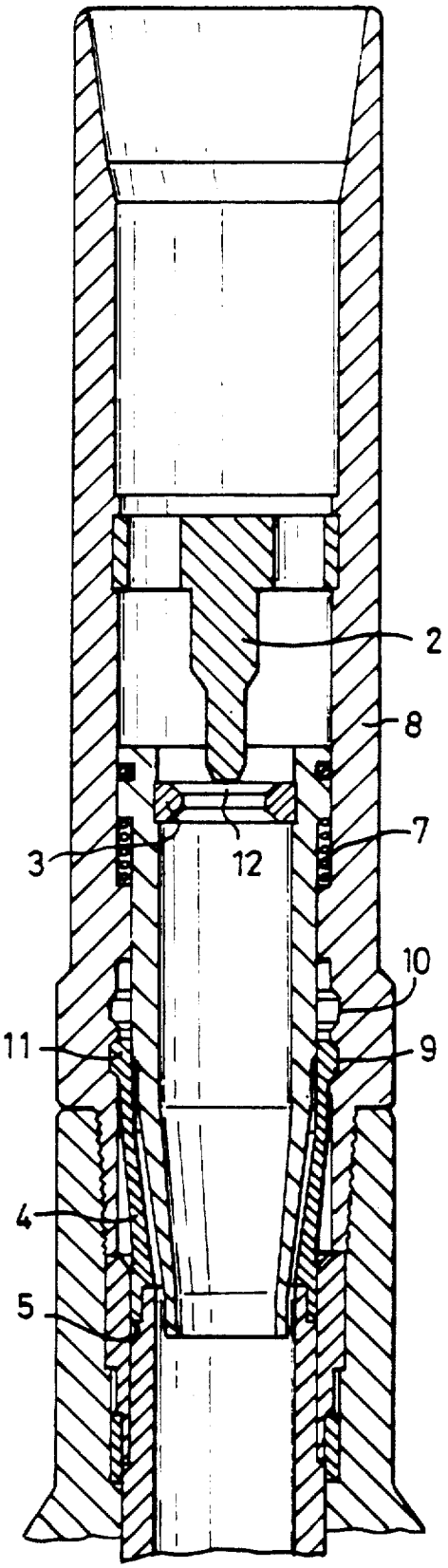
FIG. 3 is a similar view of the tool actuator of FIG. 1, in a locked, deactivating position.

Referring to FIGS. 1 to 3, the Figures show a tool actuator comprising a casing 8 containing a first member or pipe 1. FIG. 1 shows the pipe 1 in a first locking position, FIG. 2 shows the pipe 1 in an unlocking position an FIG. 3 shows the pipe 1 in a second locking position.

The pipe 1 in FIG. 1 and FIG. 3 is in the first and second locking position and in an activating or deactivating position, respectively. The pipe 1 in the unlocking position does not contact the mandrel 4, which is therefore free to move between the activating and deactivating positions.

The mandrel 4 terminates in an abutment 11 which may be received by a recess 10 in the activating position or by a recess 9 in the deactivating position; as illustrated in FIG. 1 and FIG. 3 respectively.

The tool actuator further includes a biasing means in the form of a spring 7, which biases the pipe 1 towards the unlocking position, and an obstructor member 2 which restricts the flow area in the casing 8, the obstructor member 2 being formed in two coaxial sections.

The pipe 1 includes a venturi or annular collar 3, the flow area of the casing 8 being defined as the area between the collar 3 and the obstructor member 2.

The tool actuator of FIGS. 1 to 3 when used to govern the positioning of a drill string stabilizer is described below.

Figure 4:
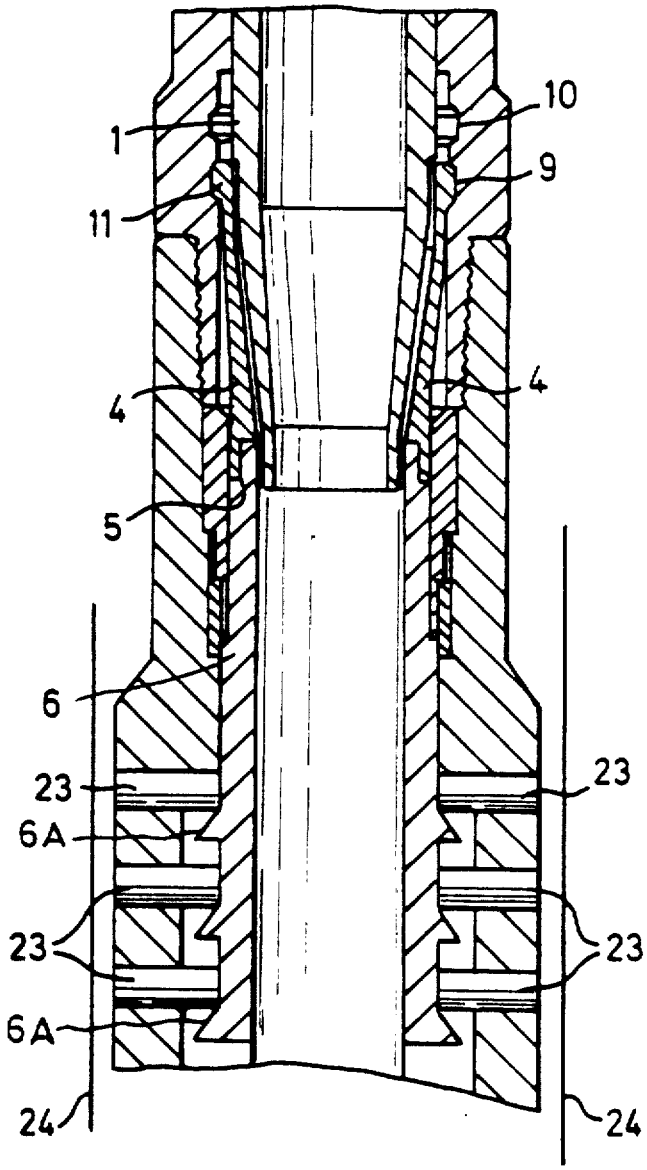
FIG. 4 is a schematic view of the tool actuator of FIGS. 1 to 3 applied to a drill string stabilizer.

The drill string stabilizer as illustrated in FIG. 4, comprises a generally cylindrical outer casing 8 and tapered cylindrical mandrel 4 mounted co-axially within the lower end of the stabilizer casing 8 so as to be capable of axial movement within the casing 8. The axial movement of the mandrel 4 is controlled by the application of weight to the drill string.

The stabilizer also comprises buttons or protrusions 23 which can be extended outwith the stabilizer outer casing 8 so as to contact the sides of the well 24 and prevent the drill string from bowing, or retracting within the stabilizer outer casing 8 thus permitting the drill string to bow.

The position of the buttons 23 is determined by the position of the tapered mandrel 4.

As weight is applied to the drill string the mandrel 4 moves upwards relative to the stabilizer casing 8. The mandrel 4 is tapered over parts of its length 6 to 6A so that the upward movement of the mandrel 4 results in the thicker parts 6 to 6A of the body of the mandrel 4 biasing the stabilizer buttons outwardly so as to protrude out of the stabilizer outer casing 8.

As weight is removed from the drill string the mandrel 4 moves downwardly with respect to the stabilizer outer casing 8 so that the thinner part of the body of the mandrel 4 contacts the stabilizer buttons 23, allowing the buttons 23 to move back inside the stabilizer outer casing 8.

As illustrated in FIGS. 1 to 3 the top portion of the mandrel 4 ends in an annular abutment 11 which is received by one of two annular recesses 9 and 10 on the inner surface of the casing 8, depending on the position of the mandrel 4, the position of the mandrel 4 being determined by the application of weight to the drill string, as normal.

The pipe 1 is located within and is capable of axial movement with respect to the outer casing 8. The position of the pipe 1 is governed by the net effect of the upward pressure on the pipe 1 exerted by biasing spring 7 coaxially mounted between the pipe 1 and outer casing 8 and the downward pressure on the pipe exerted by drilling mud which is pumped down the hollow center of the casing 8.

The drilling mud is pumped through the obstructor member 2 in the casing 8 which restricts the area of flow around the upper part of the pipe 1 and thus increases the pressure of the drilling mud. This flow is further restricted by the annular collar 3 on the pipe 1 which also increases the surface area of the pipe 1 which is acted upon by the mud flow, thus increasing the force on the pipe 1, for a given flow rate.

When the downward force due to the mud flow is greater than the upward force due to the biasing spring 7, the pipe 1 is forced downward until it contacts the abutment 11 at the end of the mandrel 4. In this way a normal drilling mud flow rate will cause the pipe 1 to bear down on the abutment 11 and thus lock it in one of the two annular recesses 9 or 10 in the stabilizer casing 8, as illustrated in FIGS. 1 and 3. In this position the mandrel 4 cannot move regardless of the weight applied to the drill string.

When it is necessary to move the mandrel 4 between its two positions, the downward force due to mud flow may be reduced by substantially lowering the flow rate, so that the upward force due to the biasing spring 7 is greater than the force exerted by the fluid. This results in the pipe 1 being biased away from the abutment 11 as illustrated in FIG. 2, and the mandrel 4 can then move due to the weight applied to the drill string, in the normal manner.

In use, assuming that the buttons are initially in the extended, activated position, the mandrel abutment 11 will be locked in the upper annular recess 10 due to the force on the abutment 11 by the pipe 1, as in FIG. 1.

To retract the buttons the mandrel 4 must first be unlocked from the aforementioned position by reducing the pressure on the pipe 1 by reducing the mud flow rate so that the biasing spring 7 can force the pipe 1 away from the abutment 11.

Secondly the weight applied to the drill string is reduced so as to allow the mandrel 4 to move downwardly, with respect to the stabilizer casing, until the mandrel abutment 11 is located in the lower annular recess 9.

At this stage the mud flow rate is increased to its normal rate again so that the pipe is biased downwards and again contacts the mandrel abutment 11, thus locking it in the deactivated position, in recess 9. The positioning of the pipe and mandrel 4 in either the activated or deactivated positions can be easily and accurately monitored from the well surface by measuring the downhole drilling mud pressure for a given flow rate, which is governed by the transverse area of the most restricted portion of its flow path.

In the locked deactivated position, FIG. 3, where the mandrel 4 and pipe 1 are at their lowest position with respect to the casing, the restriction of the mud flow at its most restricted point 12 is a minimum and the mud pressure is also a minimum, for a given flow rate.

In the unlocked position, FIG. 2, the pipe 1 is located at its uppermost point with respect to the casing and the restriction of the mud flow is a maximum and consequently the mud pressure is also a maximum, for a given flow rate.

At this point the position of the mandrel 4 can be adjusted by adjusting the weight to the drill string.

In the locked activated position, FIG. 1, the restriction of the mud flow is greater than that of the locked deactivated position and less than that of the unlocked position and consequently an intermediate mud pressure is obtained.

Consequently, the position of the pipe 1 and mandrel 4 can be determined by measurement of the fluid pressure.

In this way the position of the stabilizer buttons and the associated change in the drilling inclination can be both actuated and monitored from the well surface.

FIGS. 5 to 9 illustrate a preferred embodiment of a tool actuator. The basic principle of operation of this embodiment is the same as that of the embodiment detailed above. The most significant differences being in the shape of the obstructor member 2 and the inclusion of a double action latch 25 and spring collet 26.

The obstructor member 2, in this embodiment, is a substantially cylindrical member which tapers outwards towards its lower end.

This taper results in an increase in mud pressure as the collar 3 traverses the length of the obstructor member 2, towards the lower end, for a constant normal mud flow rate.

Figure 7:
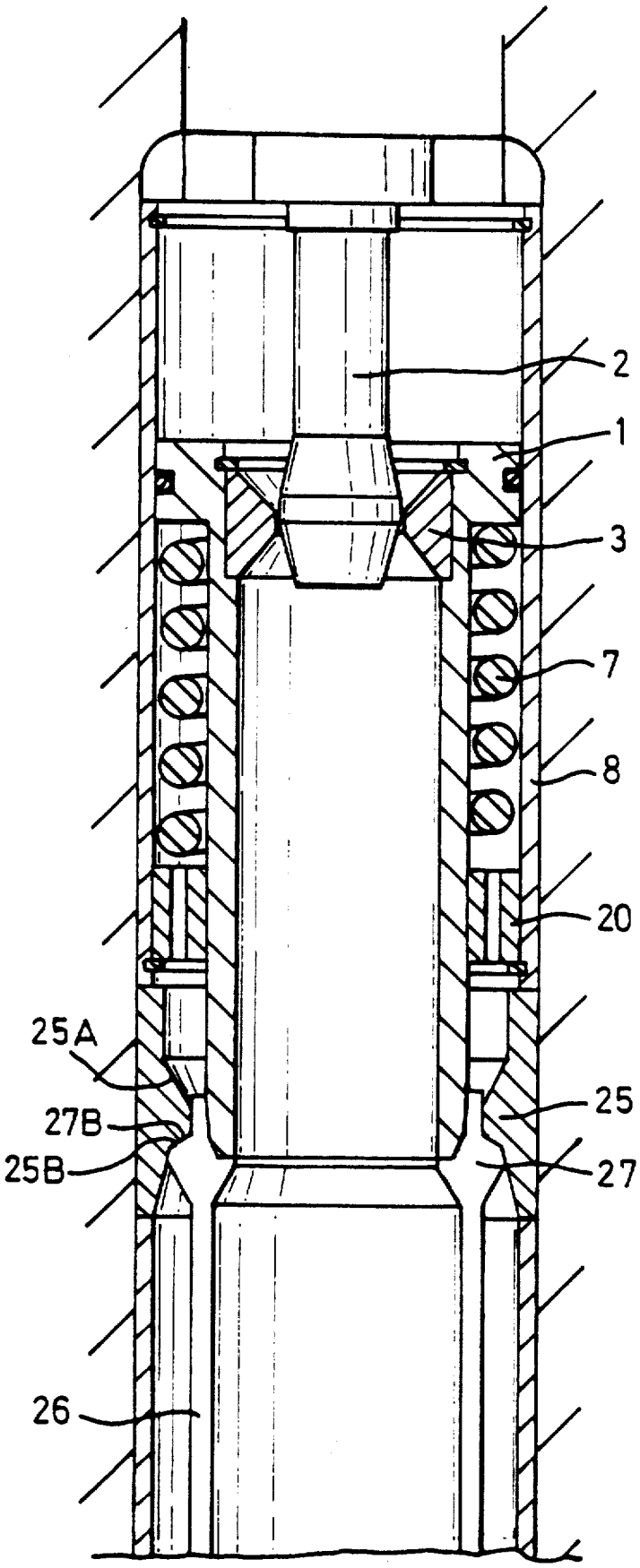
FIG. 7 is a similar view of the tool actuator of FIG. 5, in a locked, deactivating position.

This is advantageous as an increased mud pressure is required in order to force the pipe 1 downwards to lock the spring collet 26 in the deactivated position, as illustrated in FIG. 7.

Figure 5:
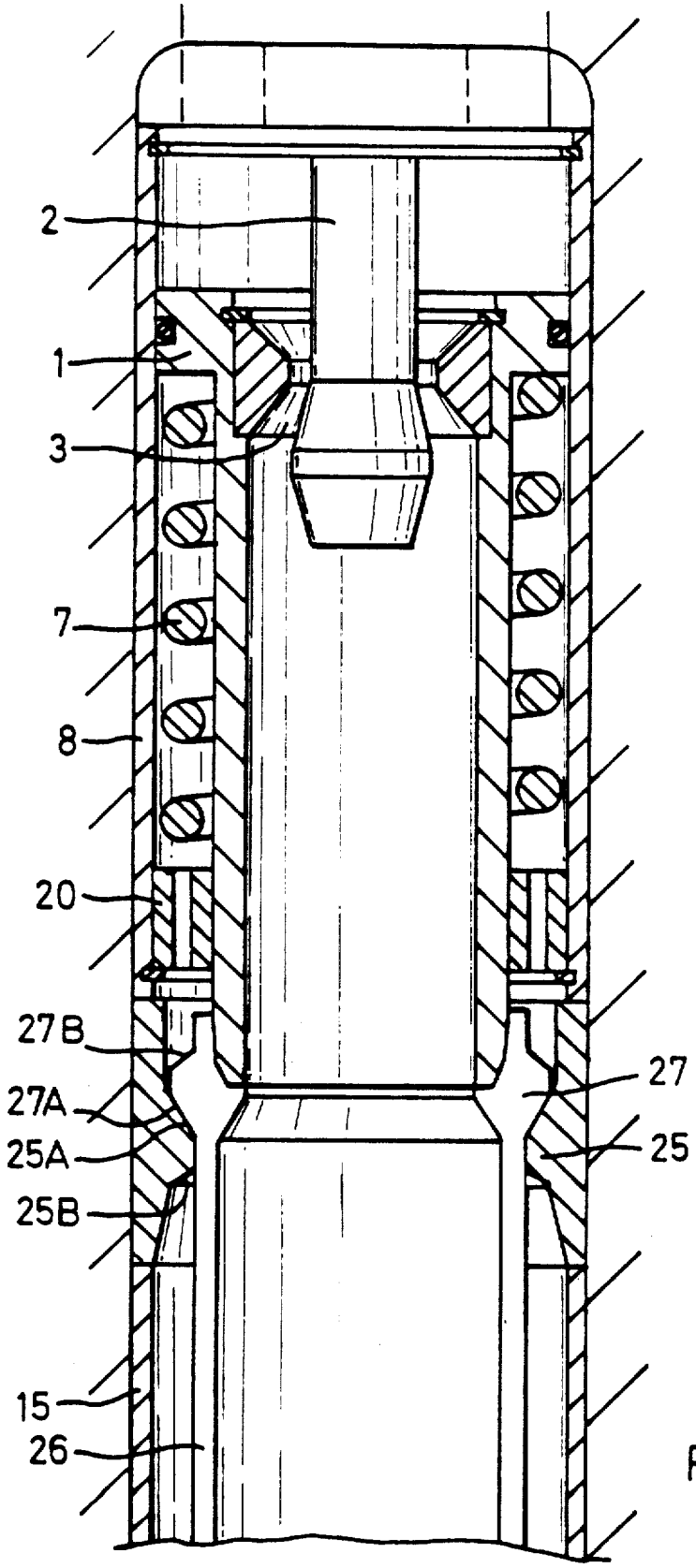
FIG. 5 is an axial sectional view of a second embodiment of a tool actuator, in a locked, activating position.
Figure 6:
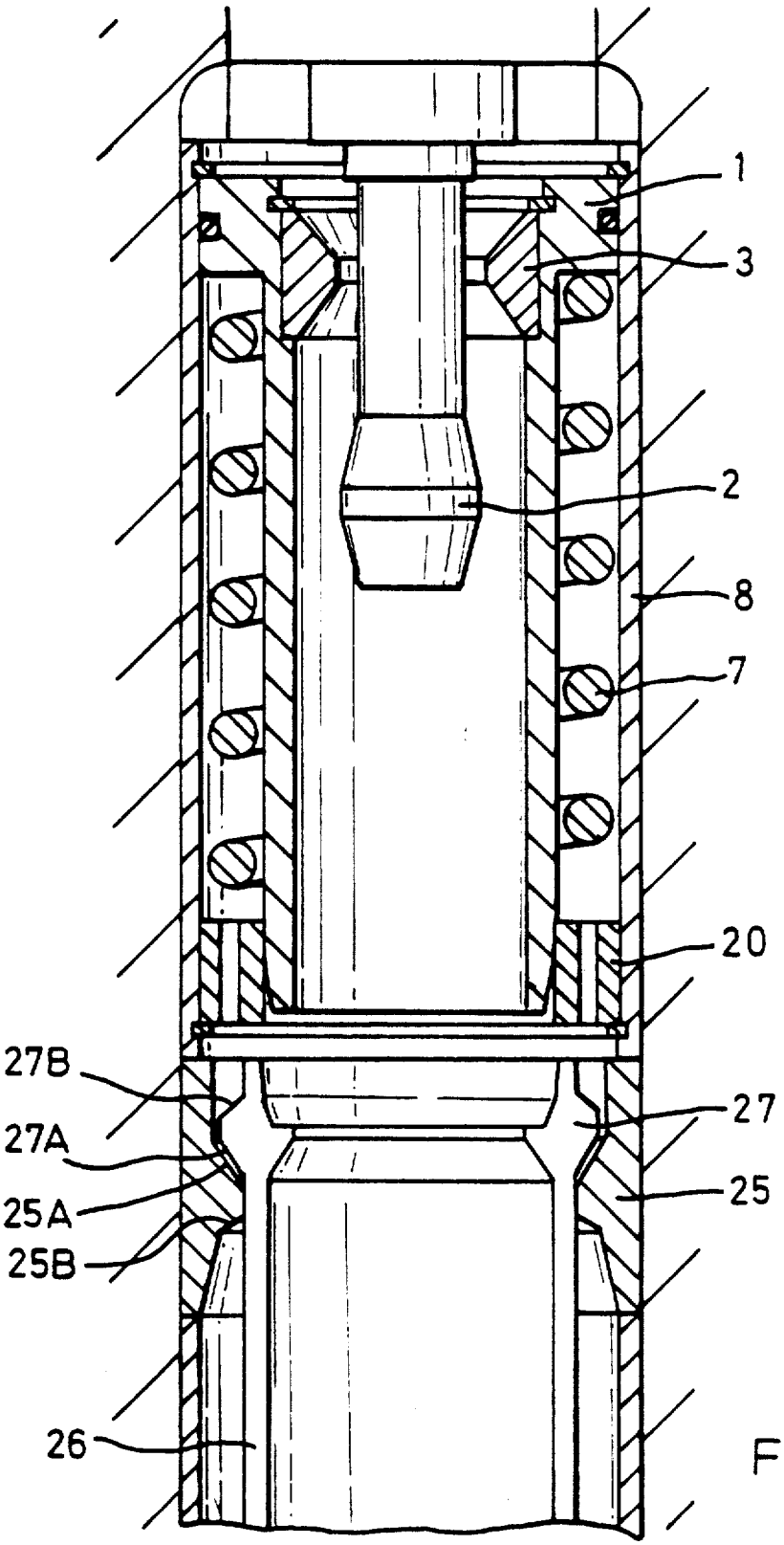
FIG. 6 is a similar view of the tool actuator of FIG. 5, in an unlocked, activating position.

With reference to FIGS. 5 to 7 the double action latch 25 is an annular collar having a first, upwardly directed, face 25A and a second, downwardly directed, face 25B formed to contact the faces 27A and 27B respectively, of the abutment 27.

Each of the sides of the spring collet 26 terminate in an abutment 27. Each of the sides may be urged outwards under the face of the pipe 1 to contact the double action latch 25. The face 27A or 27B of the abutment 27 which contacts the face 25A or 25B of the double action latch is dependant on the position of the spring collet 26, when the pipe 1 is urged downwards to contact the abutment 27.

Figure 8:
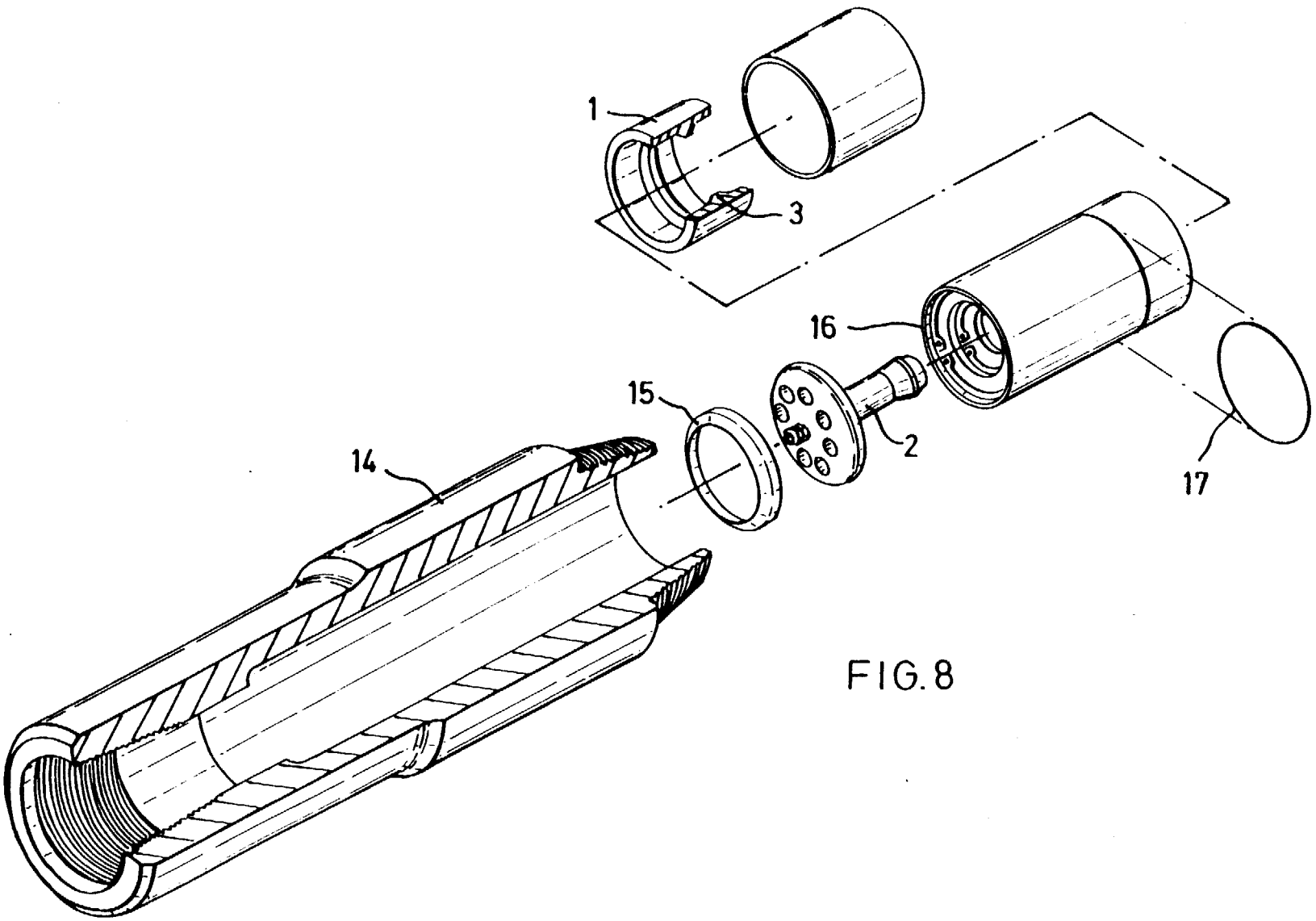
FIG. 8 is an exploded view of an obstructor member and first member of the tool actuator of FIG. 5.

FIG. 8 is an exploded view of an embodiment of the first member or pipe 1 and obstructor means 2 showing more details including the top sub 14 and a spacer ring 15 positioned between the top sub 14 and the obstructor member 2. FIG. 8 also shows a cartridge assembly 16 containing the pipe 1, and the cartridge assembly 'O' ring 17.

Figure 9:
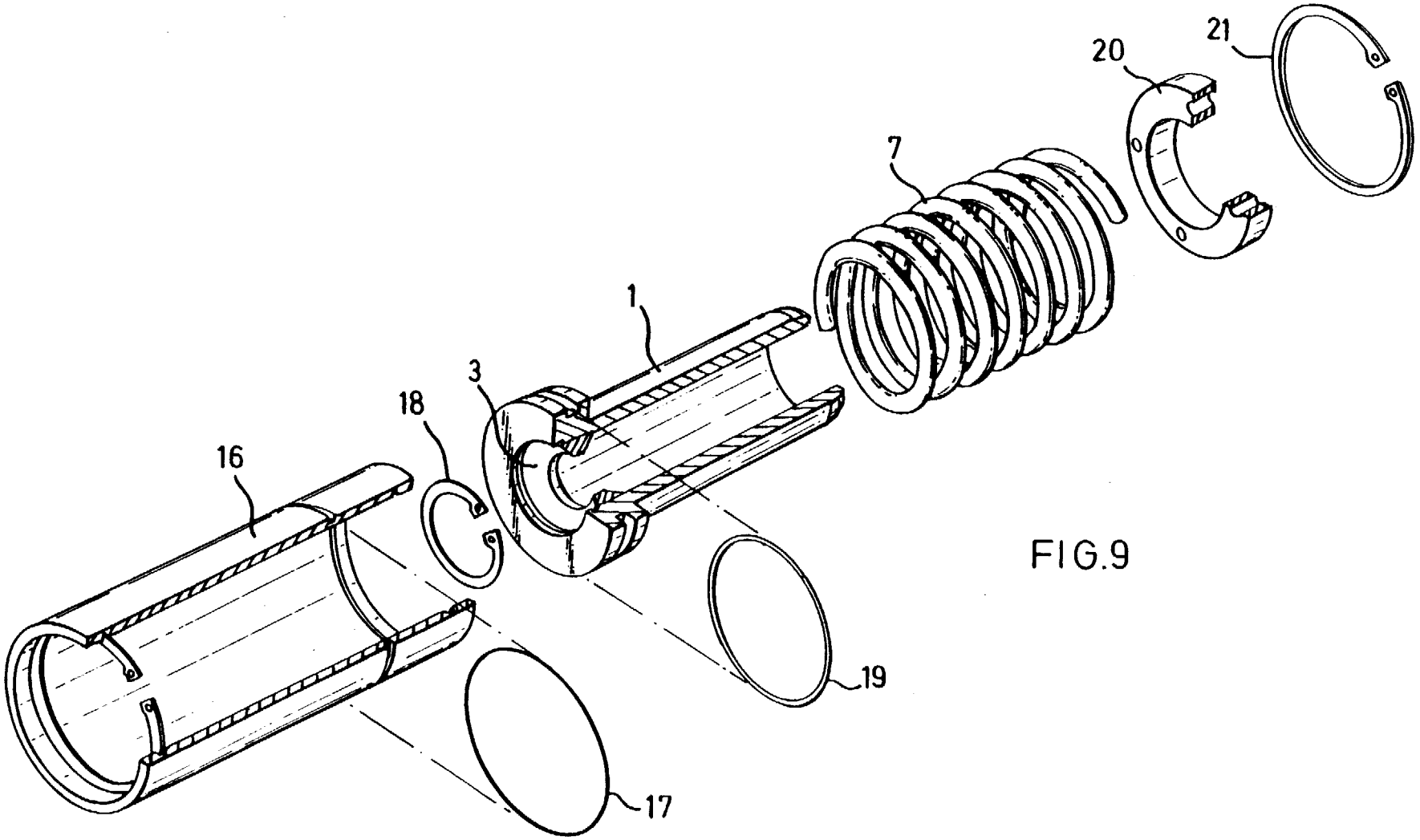
FIG. 9 is an exploded view of the first member and biasing means of the tool actuator of FIG. 5.

FIG. 9 is an exploded view of an embodiment of the first member or pipe 1 and biasing means 7 showing more details including the cartridge assembly case 16, a venturi or collar retaining clip 18, the collar 3 and 'O' ring 19. FIG. 9 also shows a guide ring 20 and circlip 21 used in securing the biasing means 7 in position.

When in use, assuming the spring collet 26 is in the activating position as illustrated in FIG. 5 mud must be pumped through the pipe 1 at a normal flow rate to produce a sufficiently high mud pressure to urge the pipe 1 down until it contacts the abutment 27. The spring collet 26 is positioned such that the face 27A of the abutment 27 contacts the face 25A of the double action latch 25, the pipe 1 locking the abutment 27 in this position.

If the mud flow rate is substantially reduced the upward force of the spring 7 will urge the pipe 1 upwards away from the abutment 27, due to the consequent reduction in mud pressure on the pipe 1, as illustrated in FIG. 6.

The spring collet 26 may now be moved to the deactivating position by the removal of weight from the drill string.

In the deactivating position the face 27B of the abutment 27 will contact the face 25B of the double action latch 25, as illustrated in FIG. 7.

At this point if the fluid flow is substantially increased to its normal flow rate the fluid pressure will force the pipe 1 downward until the pipe 1 once again contacts the abutment 27, locking the abutment 27 in this position, as illustrated in FIG. 7.

If the mud flow rate is once again substantially reduced, to the point where the spring 7 biases the pipe 1 away from the abutment 27, the collet 26 may be once again moved to the activating position by applying weight to the drill string.

Accordingly, the pipe 1 will always move to the unlocking position in conditions of reduced mud flow rate and pressure. Therefore, measurement of the mud flow rate and pressure will inform the user when the pipe 1 is in the first or second position.

Also, for a constant normal mud flow rate, the mud pressure will be different when the spring collet is in the first or second position, because of the difference in flow area, between the collar 3 and obstructor member 2. Therefore, measurement of mud flow rate and pressure will also inform the user when the spring collet 26 is in the activating or deactivating position.

The present invention provides an actuating mechanism for a downhole tool which can be set in either an activated position or a deactivated position determined by interengageable detent means on a mandrel within the casing. In the embodiment of FIGS. 1-3, the abutment 11 which alternatively engages the recesses 9 and 10 constitute the detent means. In the embodiment of FIGS. 5-9, the double-action latch engages the abutment 27 of the spring collar 26 to constitute the detent means. In each case the detent means is mechanically locked in position by the tubular member 1 which has a shoulder exposed to the thrust of the drilling mud fluids and positioned so as to be responsive to the flow rate of the mud fluids.

Modifications and improvements may be incorporated without departing from the scope of the invention.

I claim:

1. An actuating mechanism for a downhole tool which is adapted to be connected into a drill string for use with a pressurized flow of mud fluids through the drill string, the mud having a normal flow rate for effective use of the drill and a low flow rate when the drill is not in use, wherein the took is capable of being set either in an activated position or a deactivated position, said actuating mechanism comprising:

a tubular casing;

a tubular mandrel for setting the tool, the mandrel being axially slideable within the casing by the controlled application of weight on the drill string;

interengageable detent means on the mandrel and on the casing adapted to axially locate the mandrel in either of two positions corresponding respectively to the tool activated and deactivated positions; and releasable locking means for mechanically securing the mandrel in either of said two positions, said locking means comprising a tubular member axially slideably mounted within the casing and having at one end an end portion which is engageable with the mandrel to prevent disengagement of the mandrel detent means from the casing detent means, the tubular member having a shoulder which is exposed to the thrust of the mud fluids, the normal flow rate maintaining the tubular member in locking engagement with the mandrel, and resilient biasing means operable at the low mud fluid flow rate to urge the tubular member out of engagement with the mandrel, so as to afford disengagement of the mandrel and casing detent means.

2. An actuating mechanism as claimed in claim 1, including mud pressure monitoring means within the casing comprising an obstructor member mounted on the casing and projecting into the bore of the tubular member so as to limit the area within the tubular member through which the mud fluids may flow and an annular collar formed on the inner surface of the tubular member and arranged such that the flow area between the collar and the obstructor determines the pressure of mud fluid for a given flow rate, for detection at the well head.

3. An actuator mechanism as claimed in claim 1, including mud pressure monitoring means within the casing comprising an obstructor member mounted on the casing adjacent the end of the tubular member remote from said one end, said obstructor member comprising a spigot which projects axially into the bore of the tubular member so as to limit the flow area within the tubular member for the mud fluids, the spigot having a variable radius within the length of the tubular member, and an inwardly directed annular protrusion on the tubular member which in one extreme position of the tubular member is aligned with a part of the spigot having a first radial dimension and in the other extreme position of the tubular member the annular protrusion is aligned with a part of the spigot having a second radial dimension whereby, for a given flow rate the mud fluid pressures are different at the extreme positions of the tubular member.

4. An actuating mechanism as claimed in claim 1, wherein the tool is a variable stabilizer for stabilizing the drill string in a well.

5. An actuating mechanism as claimed in claim 4, wherein the variable stabilizer comprises a plurality of radially movable buttons which are mounted so as to be movable by the mandrel between an activated position wherein the buttons protrude outwardly from the stabilizer through the casing so as to contact the wall of the well, and a deactivated position wherein the buttons are retracted within the casing.

* * * * *